US012747506B2

(12) United States Patent
Rabe et al.

(10) Patent No.: US 12,747,506 B2
(45) Date of Patent: Sep. 29, 2026

(54) SYSTEM AND METHOD OF COATING AN AUTOMOTIVE PART WITH IRON OXIDE FOR AN ELECTRIC DRIVE UNIT OF A VEHICLE

(71) Applicant: GM Global Technology Operations LLC, Detroit, MI (US)

(72) Inventors: Adam Paul Rabe, Auburn Hills, MI (US); Zhe Li, Rochester, MI (US); Matthew George Keast, Clawson, MI (US); Jacob Alexander Rabe, Auburn Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 878 days.

(21) Appl. No.: 18/175,261

(22) Filed: Feb. 27, 2023

(65) Prior Publication Data

US 2024/0301560 A1 Sep. 12, 2024

(51) Int. Cl.

| | |
|---|---|
| ***C23C 22/78*** | (2006.01) |
| ***C23C 22/50*** | (2006.01) |
| *C23C 22/00* | (2006.01) |

(52) U.S. Cl.

CPC ..... *C23C 22/50* (2013.01); *C23C 22/78* (2013.01)

(58) Field of Classification Search

None

See application file for complete search history.

(56) References Cited

U.S. PATENT DOCUMENTS 4,496,401 A * 1/1985 Dawes ..... C23C 8/26 148/318

2023/0049815 A1 2/2023 Johnson et al.

FOREIGN PATENT DOCUMENTS

| | | | | |
|---|---|---|---|---|
| CN | 104250755 A | | 12/2014 | |
| CN | 107366000 A | * | 11/2017 | ..... C23G 1/18 |
| DE | 102010042425 A1 | | 4/2012 | |
| EP | 2617866 A1 | | 7/2013 | |

(Continued)

OTHER PUBLICATIONS

Sherif S. Rashwan, An investigation of ultrasonic based hydrogen production, Energy 205 (2020), 12 pages, 118006, Elsevier Ltd., Oshawa, Ontario; Canada.

(Continued)

*Primary Examiner* — Lois L Zheng

(74) *Attorney, Agent, or Firm* — Vivacqua Crane, PLLC

(57) ABSTRACT

A method of coating an automotive part for an electric drive unit is provided. The method comprises providing a part comprising a body having an outer surface and introducing the part in an aqueous coating solution comprising sodium metabisulfite and citric acid to form residual oxides on the outer surface defining a sample-water interface. The method further comprises emitting ultrasonic waves in the coating solution to generate acoustic cavitation activity at the sample-water interface and continuously form oxygen and hydrogen species. The citric acid arranged to activate the outer surface to allow for the reaction with the oxygen and hydrogen species forming iron hydroxide. The sodium metabisulfite arranged to react with the iron hydroxide generating iron oxysulfide such that the iron oxysulfide reacts with the oxygen and hydrogen species to produce iron oxide and iron sulfide on the outer surface defining a black oxide coating.

18 Claims, 2 Drawing Sheets

(56) References Cited

FOREIGN PATENT DOCUMENTS

| | | | | |
|---|---|---|---|---|
| KR | 1020240101115 | A | 7/2024 | |
| WO | WO-2020060199 | A1 * | 3/2020 | ..... H01M 10/052 |

OTHER PUBLICATIONS

Recommendations of the Working Group "Quality" (66): General Principals of using ultrasound in cleaning of Medical Devices*—Part 1, DGSV, 2010.

* cited by examiner

SYSTEM AND METHOD OF COATING AN AUTOMOTIVE PART WITH IRON OXIDE FOR AN ELECTRIC DRIVE UNIT OF A VEHICLE

INTRODUCTION

The present disclosure relates to bearings and, more particularly, automotive parts coated with iron oxide for electric drive unit bearings of vehicles.

Black oxide coatings are used to suppress white etching cracks by acting as a hydrogen diffusion barrier between the base metal and the lubricant. Black oxide coatings are also used as an insulating layer to lessen bearing failures associated with electrical damage. However, many process steps are involved and cycle times are relatively long.

SUMMARY

Thus, while current systems and methods of coating an automotive part with black oxide coating achieve their intended purpose, there is a need for a new and improved system and method of coating an automotive part black (iron) oxide for an electric drive unit of a vehicle.

In one aspect of the present disclosure, a method of coating an automotive part with iron oxide for an electric drive unit of a vehicle is provided. The method comprises providing an automotive part comprising a body having an outer surface. The part comprises steel. The method further comprises introducing the part in an aqueous coating solution comprising sodium metabisulfite, an ionic surfactant, and citric acid to form residual oxides on the outer surface of the part defining a sample-water interface.

The method further comprises emitting ultrasonic waves in the coating solution to generate acoustic cavitation activity at the sample-water interface and continuously form oxygen and hydrogen species. The citric acid is arranged to chemically activate the steel surface and to allow for the reaction with the oxygen and hydrogen species to form iron hydroxide. The sodium metabisulfite is arranged to react with the iron hydroxide and generate iron oxysulfide on the outer surface such that the iron oxysulfide reacts with the oxygen and hydrogen species and produces iron oxides (FeO, $Fe_2O_3$, $Fe_3O_4$) and iron sulfide (FeS) on the outer surface. The iron oxides and iron sulfide define a black oxide coating having iron sulfide platelets disposed thereon.

In one example, the method further comprises, prior to introducing the part in the coating solution, cleaning the part to remove residual oil from the outer surface. In another example, cleaning comprises disposing the part in a cleaning solution and emitting ultrasonic waves on the outer surface. In yet another example, the method further comprises rinsing the cleaning solution from the outer surface.

In another example, the method further comprises rinsing the black oxide coating of the outer surface with an aqueous solution to remove the cleaning solution therefrom and drying the outer surface to remove the aqueous solution from the black oxide coating. In yet another example, the coating solution comprises between 5 weight (wt) percent (%) and 20 wt % sodium metabisulfite, between 3 wt % and 15 wt % ionic surfactant, and between 0.25 wt % and 3 wt % citric acid.

In one example, the coating solution is at between 15 degrees Celsius (° C.) and 40° C. In another example, emitting ultrasonic waves on the part has a duration of between 1 minute (min) and 20 mins at a frequency of between 15 kilohertz (KHz) and 400 kHz. In yet another example, the black oxide coating has a thickness of between 1 micron and 4 microns.

In accordance with another aspect of the present disclosure, a system for coating an automotive part with iron oxide for an electric drive unit of a vehicle is provided. The system comprises an automotive part comprising a body having an outer surface, the part comprising steel. The system further comprises an introducer mechanism arranged to suspend the part in an aqueous coating solution comprising sodium metabisulfite, an ionic surfactant, and citric acid to form residual oxides on the outer surface of the part defining a sample-water interface.

The system further comprises an ultrasonic mechanism arranged to emit ultrasonic waves in the coating solution to generate acoustic cavitation activity at the sample-water interface and continuously form oxygen and hydrogen species from the residual oxides. The citric acid is arranged to chemically activate the steel surface and to allow for the reaction with the oxygen and hydrogen species to form iron hydroxide. The sodium metabisulfite is arranged to react with the iron hydroxide and generate iron oxysulfide on the outer surface such that the iron oxysulfide reacts with the oxygen and hydrogen species producing iron oxides (FeO, $Fe_2O_3$, $Fe_3O_4$) and iron sulfide (FeS) on the outer surface to define a black oxide coating having iron sulfide platelets disposed thereon.

In one embodiment, the system further comprises a cleaning unit arranged to clean the part to remove residual oil from the outer surface defining the outer surface comprising the residual oxides. In another embodiment, the cleaning unit is arranged to dispose the part in a cleaning solution and emit ultrasonic waves thereon. In yet another embodiment, the cleaning unit is arranged to rinse the cleaning solution from the outer surface.

In another embodiment, the system further comprises a rinsing unit arranged to rinse the black oxide coating of the outer surface with an aqueous solution to remove the cleaning solution therefrom. The system further comprises a drying mechanism arranged to dry the outer surface to remove the aqueous solution therefrom.

In one embodiment, the coating solution comprises between 5 weight (wt) percent (%) and 20 wt % sodium metabisulfite, between 3 wt % and 15 wt % ionic surfactant, and between 0.25 wt % and 3 wt % citric acid. In another embodiment, the coating solution is at between 15 degrees Celsius (° C.) and 40° C. In yet another embodiment, emitting ultrasonic waves on the part has a duration of between 1 minute (min) and 20 mins at a frequency of between 15 kilohertz (kHz) and 400 kHz. In still another embodiment, the black oxide coating has a thickness of between 1 micron and 4 microns.

In accordance with yet another aspect of the present disclosure, an automotive part for an electric drive unit of a vehicle is provided. The automotive part comprises an automotive part comprising a body having an outer surface. The body comprises steel and the outer surface comprising a black oxide coating. The black oxide coating comprising an iron oxide film and iron sulfide platelets disposed thereon. In one embodiment, the black oxide coating has a thickness of between 1 micron and 4 microns.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Embodiments and examples of the present disclosure provide a new and improved system and method of coating an automotive part with black (iron) oxide for an electric drive unit of a vehicle. The automotive part may be a ball bearing assembly for a rotating shaft of an electric drive unit. The automotive part comprises a body and an outer wherein the outer surface is coated with a black oxide coating comprising an iron oxide film and iron sulfide platelets disposed on the iron oxide film. As a result, the systems and methods of the present disclosure involve reduced process steps. Moreover, the systems and methods have a reduced cycle time of between about 5 mins and 20 mins.

Figure 1:
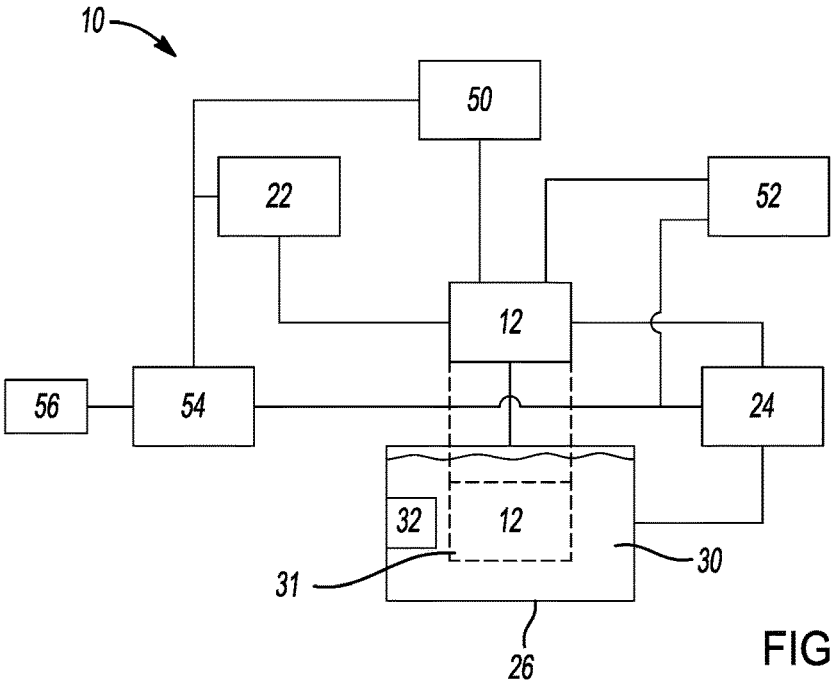
FIG. 1 is a schematic view of a system for coating an automotive part with iron oxide for an electric drive unit of a vehicle in accordance with one embodiment of the present disclosure.
Figure 2:
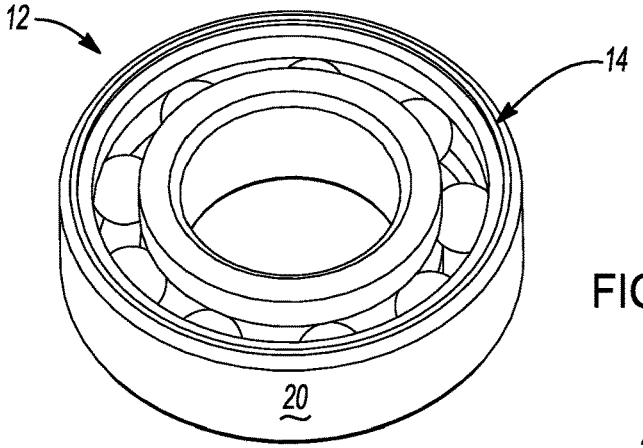
FIG. 2 is a perspective view of an automotive part to be coated with iron oxide via the system in FIG. 1.

FIG. 1 illustrates a system 10 for coating an automotive part, such as an electric drive unit bearing assembly, with iron oxide for an electric drive unit of a vehicle in accordance with one embodiment of the present disclosure. As shown in FIGS. 1-2, the system 10 comprises an automotive part 12 comprising a body 14 having an outer surface 20. In one example, the part 12 comprises steel alloy and is a ball bearing assembly for a rotating shaft of an electric drive unit of a vehicle.

Referring to FIG. 1, the system 10 further comprises a cleaning unit 22 arranged to clean the part 12 to remove residual oil from the outer surface 20. In one embodiment, the cleaning unit 22 may have a mechanical arm that is arranged to dispose the part 12 in a first tank containing a cleaning solution. In one example, the cleaning solution may be a water-based caustic cleaner. Moreover, the tank may comprise an ultrasonic device that emits ultrasonic waves through the cleaning solution and on the outer surface 20 of the part 12. After cleaning, the cleaning unit 22 is arranged to remove the part 12 from the tank and rinse the cleaning solution from the outer surface 20 of the part 12. For example, the cleaning unit 22 may use a spray device arranged to spray a water-based solution on the outer surface 20, thereby removing the cleaning solution from the outer surface 20.

Referring to FIG. 1, the system 10 further comprises an introducer mechanism 24 arranged to suspend the part 12 in a second or coating tank 26 containing an aqueous coating solution 30. For example, a robotic arm and a fixture may be implemented to dispose the part 12 in the coating tank 26 thereby submersing and suspending the part 12 in the coating solution 30. In this embodiment, the aqueous coating solution 30 comprises sodium metabisulfite, an ionic surfactant, and citric acid forming residual oxides on the outer surface 20 of the part 12 to define a sample-water interface 31.

More specifically, the coating solution 30 may comprise between 5 weight (wt) percent (%) and 20 wt %, 6 wt %, 7 wt %, 8 wt %, 10 wt %, 12 wt %, 14 wt %, 16 wt %, and 18 wt % sodium metabisulfite ($Na_2SO_3$). Moreover, the coating solution 30 may comprise between 3 wt % and 15 wt %, 4 wt %, 5 wt %, 6 wt %, 7 wt %, 8 wt %, 9 wt %, 10 wt %, 11 wt %, 12 wt %, 13 wt %, and 14 wt % surfactant. The surfactant may be a liquid detergent comprising a chlorosulfonated hydrocarbon, sodium dodecyl benzene sulphonate, or any other suitable solution without departing from the spirit of scope of the present disclosure. Additionally, the coating solution 30 may comprise between 0.25 wt % and 3 wt %, 0.5 wt %, 0.8 wt %, 1 wt %, 1.3 wt %, 1.5 wt %, 1.8 wt %, 2 wt %, 2.3 wt %, 2.5 wt %, and 2.8 wt % citric acid. Furthermore, the coating solution 30 in the coating tank 26 may have a temperature of between 15 degrees Celsius (° C.) and 40° C., 20° C., 25° C., 30° C., and 35° C.

As depicted in FIG. 1, the system 10 further comprises an ultrasonic mechanism 32 arranged to emit ultrasonic waves in the coating solution 30. The ultrasonic waves generate acoustic cavitation activity in the coating solution 30 at the sample-water interface 31. In turn, oxygen and hydrogen species are continuously formed from the acoustic cavitation activity and the residual oxides. That is, cavitation bubbles in the coating solution 30 are formed by the ultrasonic waves of the ultrasonic mechanism 32. In the cavitation bubbles, hydrogen ($H_2$) in solution and other products such as $O_2$, $H_2O_2$, OH, H, $HO_2$, and O are formed during implosion of the cavitation bubbles.

More specifically, the ultrasonic mechanism or ultrasound probe 32 is disposed in the coating solution 30 in which the part 12 is immersed. The ultrasonic mechanism 32 emits ultrasonic or sound waves through the coating solution 30 for a predetermined duration and with a predetermined frequency. Preferably, the predetermined frequency is between 15 kilohertz (kHz) and 400 kHz and more preferably between 20 KHz and 40 kHz. In other embodiments, the predetermined frequency may be 25 kHz, 30 KHz, 35 kHz, 45 kHz, 50 kHz, 55 kHz, 60 kHz, 70 kHz, 80 kHz, 100 kHz, 200 kHz, and 300 kHz. Furthermore, the predetermined duration may be between 1 minute (min) and 20 mins, 2 mins, 3 mins, 4 mins, 5 mins, 10 mins, and 15 mins.

In turn, acoustic cavitation bubbles are generated in the coating solution 30 at the sample-water interface 31. The acoustic cavitation bubbles undergo a sequence of dynamics in formation: bubble formation; growth in volume due to pressure and temperature; an unstable phase; and a collapse (implosion) due to excessive pressure (up to greater than 2000 ATMs) and temperature (up to greater than 5000 K) buildup in the bubbles. As a result, a dissociation of water vapor to hydroxyl and reactive oxygen/hydrogen radicals or species, including $O_2$, $H_2O_2$, OH, H, $HO_2$, O, and $H_2$, occur. Such oxygen/hydrogen species are combined by chemical reactions to form hydrogen and oxygen molecules, hydrogen peroxide, and other reactive species. The chemical reactions may include:

$$H_2O \longleftrightarrow *OH + H* \quad (1)$$

$$*OH + H* \longleftrightarrow H_2 + O \quad (2)$$

$$H* + O_2 \longleftrightarrow HO_2 \quad (3)$$

$$HO_2 + H* \longleftrightarrow H_2 + O_2 \quad (4)$$

where $H_2O$ is water in the aqueous coating solution 30, *OH is hydroxide radical, H* is hydrogen radical, $H_2$ is hydrogen, O is oxygen atom, $O_2$ is oxygen molecule, $HO_2$ is hydroperoxyl.

In this example, the citric acid is arranged to chemically activate the steel surface and to allow for the reaction with oxygen/hydrogen species and iron (Fe) ions at the sample-water interface 31 forming iron hydroxide, $Fe(OH)_2$. Moreover, the sodium metabisulfite is arranged to react with the iron hydroxide generating iron oxysulfide ($FeSO_3$) at the sample-water interface 31 on the outer surface 20. In turn, the iron oxysulfide reacts with oxygen/hydrogen species to produce an iron oxide (FeO, $Fe_2O_3$, $Fe_3O_4$) film 34 and iron sulfide (FeS) platelets 36 on the outer surface 20. That is, a first portion of the iron oxysulfide reacts with oxygen to produce the iron oxide film 34 on the outer surface 20. Additionally, a second portion of the iron oxysulfide reacts with hydrogen to produce the iron sulfide platelets 36 disposed in the iron oxide film 34.

Figure 3:
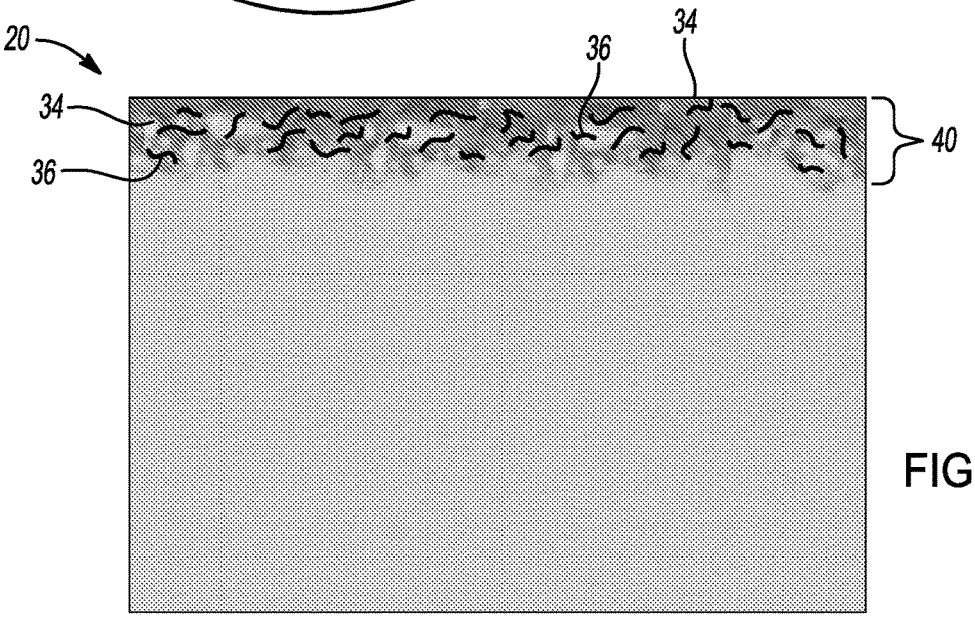
FIG. 3 is a conceptual view of a cross-section of an automotive part coated with iron oxide via the system in FIG. 1.
Figure 4:
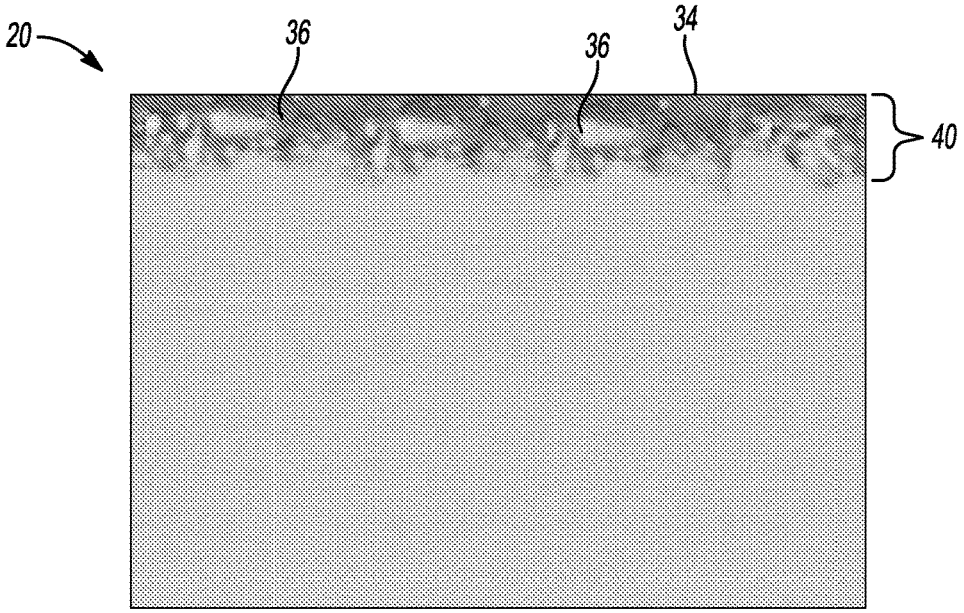
FIG. 4 is an SEM image of a cross-section of an automotive part coated with iron oxide via the system in FIG. 1.

As shown in FIGS. 3-4, the iron oxide and iron sulfide are formed on the outer surface 20 to define a black oxide coating 40 disposed on the outer surface 20. The black oxide coating 40 comprises an iron oxide film 34 and iron sulfide platelets 36 disposed in the film 34. In this embodiment, the black oxide coating 40 may comprise between 50 wt % and 100 wt %, 55 wt %, 60 wt %, 65 wt %, 70 wt %, 75 wt %, 80 wt %, 85 wt %, 90 wt %, and 95 wt % iron oxide. Additionally, the black oxide coating 40 may comprise between 0 wt % and 50 wt %, 10 wt %, 15 wt %, 20 wt %, 25 wt %, 30 wt %, 35 wt %, 40 wt %, and 45 wt % iron sulfide. Furthermore, the black oxide coating 40 has a thickness of between 0.5 micron and 4 microns, 1 micron, 1.5 micron, 2 microns, 2.5 microns, 3 microns, and 3.5 microns.

Referring to FIG. 1, the system 10 further comprises a rinsing unit 50 arranged to rinse the black oxide coating 40 on the outer surface 20 with an aqueous solution to remove the cleaning solution therefrom. In one embodiment, the robotic arm of the introducer unit may remove the part 12 from the coating tank 26 and a spray mechanism may be used to rinse the black oxide coating 40 to remove the cleaning solution therefrom. Alternatively, the part 12 may be moved to a third tank containing a water-based or alcohol-based solution in circulation to remove the cleaning solution from the part 12. Other suitable ways of removing the cleaning solution from the part 12 may be used without departing from the spirit or scope of the present disclosure.

As depicted in FIG. 1, the system 10 further comprises a drying mechanism 52 arranged to dry the outer surface 20 to remove the water-based/alcohol-based solution therefrom. In this embodiment, the drying mechanism 52 may be a blower, a drying cabinet, or a drying tunnel using air or nitrogen at 40° C. to 50° C.

As depicted in FIG. 1, the system 10 further comprises at least one controller 54 in communication with the cleaning unit 22, the introducer mechanism 24, the coating tank 26, the ultrasonic mechanism 32, the rinsing unit 50, and the drying mechanism 52. The controller 54 is arranged to control the cleaning unit 22, the introducer mechanism 24, the coating tank 26, the ultrasonic mechanism 32, the rinsing unit 50, and the drying mechanism 52. The system 10 further comprises a power source 56 in communication with the cleaning unit 22, the introducer mechanism 24, the coating tank 26, the ultrasonic mechanism 32, the rinsing unit 50, the drying mechanism 52, and the controller 54. The power source 56 is arranged to power the cleaning unit 22, the introducer mechanism 24, the coating tank 26, the ultrasonic mechanism 32, the rinsing unit 50, the drying mechanism 52, and the controller 54.

As a result, the system 10 of the present disclosure involves reduced process steps. Moreover, the system 10 has a reduced cycle time of between about 5 mins and 20 mins.

Figure 5:
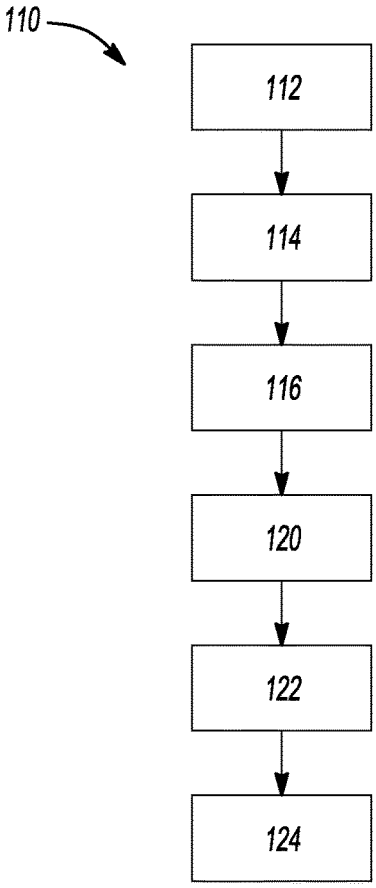
FIG. 5 is a flowchart of a method of coating an automotive part with iron oxide for an electric drive unit of a vehicle in accordance with one example of the present disclosure.

FIG. 5 illustrates a flowchart for a method 110 of coating an automotive part with iron oxide for an electric drive unit of a vehicle is provided. In this example, the method 110 may be implemented by the system 10 in FIG. 1. As shown in FIG. 5, the method 110 comprises in box 112 providing an automotive part 12 (FIG. 1). As depicted in FIGS. 1-2 and discussed above, the automotive part 12 comprises a body 14 having an outer surface 20. In one example, the part 12 comprises steel and is a ball bearing assembly for a rotating shaft of an electric drive unit of a vehicle.

As shown in FIG. 5, the method 110 further comprises in box 114 cleaning the part 12 to remove residual oil from the outer surface 20. In one example, the cleaning unit 22 of the system 10 may be implemented to remove residual oil from the outer surface 20. As such, a mechanical arm may be arranged to dispose the part 12 in a first tank containing a cleaning solution. In one example, the cleaning solution may be a water-based caustic cleaner. Moreover, the tank may comprise an ultrasonic device that emits ultrasonic waves through the cleaning solution and on the outer surface 20 of the part 12. After cleaning as in the system 10 discussed above, the cleaning unit 22 is arranged to remove the part 12 from the tank and rinse the cleaning solution from the outer surface 20 of the part 12. For example, the cleaning unit 22 may use a spray device arranged to spray a water-based solution on the outer surface 20, thereby removing the cleaning solution from the outer surface 20.

As depicted in FIG. 5, the method 110 further comprises in box 116 introducing the part 12 in an aqueous coating solution 30 comprising sodium metabisulfite, an ionic surfactant, and citric acid chemically activating the outer surface 20 of the part 12 defining a sample-water interface 31. In this example, the introducer mechanism 24 of the system 10 may be implemented to suspend the part 12 in the coating tank 26 containing an aqueous coating solution 30. For example, a robotic arm and a fixture may be implemented to dispose the part 12 in the coating tank 26 thereby submersing and suspending the part 12 in the coating solution 30. As in the system 10 above, the aqueous coating solution 30 comprises sodium metabisulfite, an ionic surfactant, and citric acid forming residual oxides on the outer surface 20 of the part 12 to define a sample-water interface 31.

More specifically, the coating solution 30 may comprise between 5 weight (wt) percent (%) and 20 wt %, 6 wt %, 7 wt %, 8 wt %, 10 wt %, 12 wt %, 14 wt %, 16 wt %, and 18 wt % sodium metabisulfite ($Na_2SO_3$). Moreover, the coating solution 30 may comprise between 3 wt % and 15 wt %, 4 wt %, 5 wt %, 6 wt %, 7 wt %, 8 wt %, 9 wt %, 10 wt %, 11 wt %, 12 wt %, 13 wt %, and 14 wt % surfactant. The surfactant may be a liquid detergent comprising a chlorosulfonated hydrocarbon, sodium dodecyl benzene sulphonate, or any other suitable solution without departing from the spirit or scope of the present disclosure. Additionally, the coating solution 30 may comprise between 0.25 wt % and 3 wt %, 0.5 wt %, 0.8 wt %, 1 wt %, 1.3 wt %, 1.5 wt %, 1.8 wt %, 2 wt %, 2.3 wt %, 2.5 wt %, and 2.8 wt % citric acid. Furthermore, the coating solution 30 in the coating tank 26 may have a temperature of between 15 degrees Celsius (C) and 40° C., 20° C., 25° C., 30° C., and 35° C.

The method 110 further comprises in box 120 emitting ultrasonic waves in the coating solution 30. As in the system 10 of FIG. 1, the ultrasonic mechanism 32 may be implemented to emit ultrasonic waves in the coating solution 30. The ultrasonic waves generate acoustic cavitation activity in the coating solution 30 at the sample-water interface 31. In turn, oxygen and hydrogen species are continuously formed from the acoustic cavitation activity and the residual oxides. That is, cavitation bubbles in the coating solution 30 are formed by the ultrasonic waves of the ultrasonic mechanism 32. In the cavitation bubbles, hydrogen ($H_2$) in solution and other products such as $O_2$, $H_2O_2$, OH, H, $HO_2$, and O are formed during implosion of the cavitation bubbles.

More specifically, the ultrasonic mechanism 32 or ultrasound probe is disposed in the coating solution 30 in which the part 12 is immersed. The ultrasonic mechanism 32 emits ultrasonic or sound waves through the coating solution 30 for a predetermined duration and with a predetermined frequency. Preferably, the predetermined frequency is between 15 kilohertz (kHz) and 400 kHz and more preferably between 20 kHz and 40 kHz. In other embodiments, the predetermined frequency may be 25 kHz, 30 KHz, 35 kHz, 45 kHz, 50 KHz, 55 kHz, 60 kHz, 70 kHz, 80 kHz, 100 kHz, 200 kHz, and 300 kHz. Furthermore, the predetermined duration may be between 1 minute (min) and 20 mins, 2 mins, 3 mins, 4 mins, 5 mins, 10 mins, and 15 mins.

In turn, acoustic cavitation bubbles are generated in the coating solution 30 at the sample-water interface 31. The acoustic cavitation bubbles undergo a sequence of dynamics in formation: bubble formation; growth in volume due to pressure and temperature; an unstable phase; and a collapse (implosion) due to excessive pressure (up to greater than 2000 ATMs) and temperature (up to greater than 5000 K) buildup in the bubbles. As a result, a dissociation of water vapor to hydroxyl and reactive oxygen/hydrogen radicals or species, including $O_2$, $H_2O_2$, OH, H, $HO_2$, O, and $H_2$, occur. Such oxygen/hydrogen species are combined by chemical reactions to form hydrogen and oxygen molecules, hydrogen peroxide, and other reactive species. As in the system 10 above, the chemical reactions may include:

$$H_2O \longleftrightarrow {}^*OH + H^* \quad (1)$$

$$^*OH + H^* \longleftrightarrow H_2 + O \quad (2)$$

$$H^* + O_2 \longleftrightarrow HO_2 \quad (3)$$

$$HO_2 + H^* \longleftrightarrow H_2 + O_2 \quad (4)$$

where $H_2O$ is water in the aqueous coating solution 30, *OH is hydroxide radical, H* is hydrogen radical, $H_2$ is hydrogen, O is oxygen atom, $O_2$ is oxygen molecule, $HO_2$ is hydroperoxyl.

In this example, the citric acid is arranged to react with oxygen/hydrogen species and iron (Fe) ions at the sample-water interface 31 forming iron hydroxide, $Fe(OH)_2$. Moreover, the sodium metabisulfite is arranged to react with the iron hydroxide generating iron oxysulfide ($FeSO_3$) at the sample-water interface 31 on the outer surface 20. In turn, the iron oxysulfide reacts with oxygen/hydrogen species to produce an iron oxide ($Fe_2O_3$) film 34 and iron sulfide (FeS) platelets 36 on the outer surface 20. That is, a first portion of the iron oxysulfide reacts with oxygen to produce the iron oxide film 34 on the outer surface 20. Additionally, a second portion of the iron oxysulfide reacts with hydrogen to produce the iron sulfide platelets 36 disposed in the iron oxide film 34.

In this example, the iron oxide and the iron sulfide are formed on the outer surface 20 to define a black oxide coating 40 disposed on the outer surface 20. The black oxide coating 40 comprises an iron oxide film 34 and iron sulfide platelets 36 disposed thereon. In this embodiment, the black oxide coating 40 may comprise between 50 wt % and 100 wt %, 55 wt %, 60 wt %, 65 wt %, 70 wt %, 75 wt %, 80 wt %, 85 wt %, 90 wt %, and 95 wt % iron oxide. Additionally, the black oxide coating 40 may comprise between 0 wt % and 50 wt %, 10 wt %, 15 wt %, 20 wt %, 25 wt %, 30 wt %, 35 wt %, 40 wt %, and 45 wt % iron sulfide. Furthermore, the black oxide coating 40 has a thickness of between 0.5 micron and 4 microns, 1 micron, 1.5 micron, 2 microns, 2.5 microns, 3 microns, and 3.5 microns.

Referring to FIG. 5, the method 110 further comprises in box 122 rinsing the black oxide coating 40 of the outer surface 20 with an aqueous solution to remove the cleaning solution therefrom. In this example, the rinsing unit 50 of the system 10 may be implemented to rinse the black oxide coating 40 on the outer surface 20 with an aqueous solution to remove the cleaning solution therefrom. In one example, the robotic arm of the introducer unit may remove the part 12 from the coating tank 26 and a spray mechanism may be used to rinse the black oxide coating 40 to remove the cleaning solution therefrom. Alternatively, the part 12 may be moved to a third tank containing a water-based or alcohol-based solution in circulation to remove the cleaning solution from the part 12. Other suitable ways of removing the cleaning solution from the part 12 may be used without departing from the spirit or scope of the present disclosure.

As depicted in FIG. 5, the method 110 further comprises in box 124 drying the outer surface 20 to remove the aqueous solution from the black oxide coating 40. In this example, the drying mechanism 52 of the system 10 may be implemented to dry the outer surface 20 to remove the water-based/alcohol-based solution therefrom. As mentioned, the drying mechanism 52 may be a blower, a drying cabinet, or a drying tunnel using air or nitrogen at 40° C. to 50° C.

As a result, the method 110 of the present disclosure involves reduced process steps. Moreover, the method 110 has a reduced cycle time of between about 5 mins and 20 mins.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method of coating an automotive part with iron oxide for an electric drive unit of a vehicle, the method comprising:

providing an automotive part comprising a body having an outer surface, the part comprising steel;

introducing the part in an aqueous coating solution comprising sodium metabisulfite, an ionic surfactant, and citric acid to form residual oxides on the outer surface of the part defining a sample-water interface; and emitting ultrasonic waves in the coating solution to generate acoustic cavitation activity at the sample-water interface and continuously form oxygen and hydrogen species from the residual oxides, the citric acid arranged to react with the oxygen and hydrogen species and form iron hydroxide, the sodium metabisulfite arranged to react with the iron hydroxide and generate iron oxysulfide on the outer surface such that the iron oxysulfide reacts with the oxygen and hydrogen species and produces iron oxide and iron sulfide on the outer surface defining a black oxide coating having iron sulfide platelets disposed thereon.

2. The method of claim 1 further comprising, prior to introducing the part in the coating solution, cleaning the part to remove residual oil from the outer surface.

3. The method of claim 2 wherein cleaning comprises:

disposing the part in a cleaning solution; and emitting ultrasonic waves on the outer surface.

4. The method of claim 3 further comprising rinsing the cleaning solution from the outer surface.

5. The method of claim 1 further comprising:

rinsing the black oxide coating of the outer surface with an aqueous solution to remove the cleaning solution therefrom; and drying the outer surface to remove the aqueous solution from the black oxide coating.

6. The method of claim 1 wherein the coating solution comprises between 5 weight (wt) percent (%) and 20 wt % sodium metabisulfite, between 3 wt % and 15 wt % ionic surfactant, and between 0.25 wt % and 3 wt % citric acid.

7. The method of claim 1 wherein the coating solution is at between 15 degrees Celsius (° C.) and 40° C.

8. The method of claim 1 wherein emitting ultrasonic waves on the part has a duration of between 1 minute (min) and 20 mins at a frequency of between 15 kilohertz (kHz) and 400 kHz.

9. The method of claim 1 wherein the black oxide coating has a thickness of between 1 micron and 4 microns.

10. A system for coating an automotive part with iron oxide for an electric drive unit of a vehicle, the system comprising:

an automotive part comprising a body having an outer surface, the part comprising steel;

an introducer mechanism arranged to suspend the part in an aqueous coating solution comprising sodium metabisulfite, an ionic surfactant, and citric acid to chemically activate the outer surface of the part defining a sample-water interface; and an ultrasonic mechanism arranged to emit ultrasonic waves in the coating solution to generate acoustic cavitation activity at the sample-water interface and continuously form oxygen and hydrogen species from residual oxides, the citric acid arranged to chemically activate the outer surface and to allow a reaction with the oxygen and hydrogen species to form iron hydroxide, the sodium metabisulfite arranged to react with the iron hydroxide and generate iron oxysulfide on the outer surface such that the iron oxysulfide reacts with the oxygen and hydrogen species producing iron oxide and iron sulfide on the outer surface to define a black oxide coating having iron sulfide platelets disposed thereon.

11. The system of claim 10 further comprising:

a cleaning unit arranged to clean the part to remove residual oil from the outer surface.

12. The system of claim 11 wherein the cleaning unit is arranged to dispose the part in a cleaning solution and emit ultrasonic waves thereon.

13. The system of claim 12 wherein the cleaning unit is arranged to rinse the cleaning solution from the outer surface.

14. The system of claim 10 further comprising:

a rinsing unit arranged to rinse the black oxide coating of the outer surface with an aqueous solution to remove a cleaning solution therefrom; and a drying mechanism arranged to dry the outer surface to remove the aqueous solution therefrom.

15. The system of claim 10 wherein the coating solution comprises between 5 weight (wt) percent (%) and 20 wt % sodium metabisulfite, between 3 wt % and 15 wt % ionic surfactant, and between 0.25 wt % and 3 wt % citric acid.

16. The system of claim 10 wherein the coating solution is at between 15 degrees Celsius (° C.) and 40° C.

17. The system of claim 10 wherein emitting ultrasonic waves on the part has a duration of between 1 minute (min) and 20 mins at a frequency of between 15 kilohertz (kHz) and 400 kHz.

18. The system of claim 10 wherein the black oxide coating has a thickness of between 1 micron and 4 microns.

* * * * *